US005295665A

United States Patent [19]

Mackie

[11] Patent Number: 5,295,665

[45] Date of Patent: * Mar. 22, 1994

[54] APPARATUS FOR BENEFICIATING ORES

[76] Inventor: Daniel A. Mackie, 474 Copeland Court, Oakville, Ontario, L6J 4B9, Canada

[ * ] Notice: The portion of the term of this patent subsequent to Feb. 12, 2008 has been disclaimed.

[21] Appl. No.: 646,952

[22] Filed: Jan. 23, 1991

Related U.S. Application Data

[63] Continuation-in-part of Ser. No. 273,536, Nov. 21, 1988, Pat. No. 4,991,824.

[51] Int. Cl.[5] ..... C22B 3/02

[52] U.S. Cl. ..... 266/168; 422/269; 209/461

[58] Field of Search ..... 266/168, 269, 461; 422/269, 273, 264; 134/60, 66; 137/403, 404, 396; 222/164, 166, 167; 209/458, 461, 490, 492, 501

[56] References Cited

U.S. PATENT DOCUMENTS 1,946,663 2/1934 Behnke ..... 209/492

3,860,394 1/1975 Tepas, Jr. et al. ..... 422/269

*Primary Examiner*—Melvyn J. Andrews

*Attorney, Agent, or Firm*—Arne I. Fors

[57] ABSTRACT

A method and apparatus for treating mineral-bearing ores and, more particularly, for treating particulate ores containing precious metals, base metals and the like for separating and recovering said values by classifying the particulate ore on a bed of particulate material, preferably coarse particulate material, and by continuously chemically leaching the said values from the ore. In accordance with an embodiment of the invention, particulated ore is fluidized and intermittently moved through a tank to classify the ore particles into strata according to size, shape and density to beneficiate values, either heavier or lighter than the gangue, for recovery of concentrated values. In accordance with another embodiment of the present invention, crushed or ground ore is moved through a vat leaching jig in such a manner as to cause the heavier metal-laden or other values-laden particles or larger gangue particles to differentially settle to the bottom of the apparatus, which can then be extracted separately and wholly from the values such as gold or precious metal values which may be chemically leached from the ore and recovered by filtering through the bed of particulate material.

27 Claims, 5 Drawing Sheets

APPARATUS FOR BENEFICIATING ORES

This is a continuation-in-part of application Ser. No. 273,536 filed Nov. 21, 1988, now U.S. Pat. No. 4,991,824.

BACKGROUND OF THE INVENTION

This invention relates to a method and apparatus for the beneficiating of ores and is particularly directed to a method and apparatus for classifying ores by size, shape and density while concurrently leaching values from said ores.

Current practice in leaching of gold and other precious metals from an ore involves crushing and grinding the ore to reduce its largest particle size to the point where intimate mixing of a leaching solution, such as sodium cyanide in water, with the particles will cause the gold or precious metal in the particles to dissolve into the solution from which the gold or precious metals are extracted at a later stage in a process plant.

In gold mills currently in use ore which has been diluted in water during the conventional grinding and classification process in grinding mills is thickened in a rake thickener or other device to about 50% solids by weight and then pumped as a slurry to a series of tanks where leaching agents are added. By keeping the slurry agitated with paddle mixers or other mechanical, pneumatic or hydraulic means, intimate mixing of the particles and leaching in solution takes place. Usually a series of tanks are used, one overflowing to the next, such that a leaching time of 12 to 72 hours takes place.

Recently, the high cost of processing low-grade gold and precious metals ores has led to cheaper methods of leaching such as "heap leaching" and "vat leaching".

Heap leaching involves placing ore as a layer on a pad on the ground or other prepared surface. A leaching agent is sprayed onto the layer of ore, after which it percolates through the pile, dissolving some of the gold or precious metals. The solution is then collected by drainage underneath and around the pile to a sump, where the solution may be recirculated to the top of the ore pile as often as is necessary to leach out the gold or precious metals, or pumped to a plant to have the gold or precious metals extracted from the solution.

Vat leaching is similar to heap leaching, except that the ore is sometimes ground and placed in a pit or like tank instead of a pile such that the ore is immersed for a more effective soaking to improve contact of the leaching solution with the ore.

Heap leaching or vat leaching is not nearly as efficient as conventional leaching in agitated tanks because the larger particle sizes and lack of mixing does not allow an intimate contact to be made between the leaching agent and the gold or precious metals. Leaching times are typically 10 to 15 days for vat leaching and weeks or months for heap leaching. In addition, both methods are batch processes, requiring adding and removing the ore from the leach area by mechanical means.

It is known to beneficiate ores by classifying solids in slurries using beds fluidized by a counter-current flow of a liquid or gas medium. Known methods, such as methods for separating bitumen from oil sands, use a continuous flow of rising fluid, usually water, counter-current to descending solids and effect a separation according to size, shape and density. The product recovered usually is substantially diluted by the volume of separating medium required and must be thickened.

It is also known to beneficiate ores by classifying the ore to separate values from the gangue, and continuously chemically leaching the said values from the ore.

The intermittent fluidization of particulated ore in a tank has been used to classify ore particles into strata according to size, shape and density to beneficiate values as disclosed in co-pending U.S. patent application Ser. No. 273,536, filed Nov. 21, 1988 whereby the intermittent fluidization creates a tendency in the stratified particles to move from the feed end of the tank to the discharge end of the tank. A valve system is utilized to recycle lixivium and to generate the high pressure force required for intermittent fluidization. The provision of increased feed pressure of the fluidizing leach solution by means of a reservoir tank having liquid under a substantially higher pressure maintained by a pump is also disclosed. The present invention is an improvement over the prior art as it avoids the need for such increased pressure through the utilization of a rotating drum, either with or without hydraulic or pneumatic means, which continuously fills and intermittently supplies the lixivium under a fluidizing pressure head.

The present invention obviates the need for a valve system by utilizing a continuous flow of leach solution.

The present invention enables particulate ore to be rinsed several times within the confines of the tank before the ore is discharged to a tailings discharge conveyor. Such rinsing enables recovery of values which would otherwise be lost if they remained affixed to the tailings. The present invention employs intermittent fluidizing of tailings with a rinse solution, pressure being supplied by the use of a rotatable drum mechanism.

SUMMARY OF THE INVENTION

This invention relates to a method and apparatus for treating mineral-bearing ores and, more particularly, for treating ores containing precious metals, base metals and the like values by providing a means to extract the metal or other values from a particulated ore by classifying the ore to separate values from the gangue, and by continuously chemically leaching the said values from the ore. In accordance with an embodiment of the invention, particulated ore is fed into a tank, fluidized and intermittently moved through the tank to classify the ore particles into strata according to size, shape and density to beneficiate values, either heavier or lighter than the gangue, for recovery of concentrated values. In accordance with another embodiment of the present invention, crushed or ground ore is moved through a vat leaching by a fluidizing leach solution in such a manner as to cause the heavier metal-laden or other values-laden particles or larger particles to differentially settle to the bottom of the apparatus, which can then be extracted separately and wholly from the values such as gold or precious metal values which may be chemically leached from the ore and recovered by filtering through an underlying bed of coarse particulate material.

In its broad aspect, the method of the invention for treating a particulate ore in a tank having a feed end, a discharge end, and a bottom, for the recovery of contained values therefrom comprises the steps of forming a bed of coarse particulate material on the bottom of the tank, feeding said particulate material into the tank at the feed end thereof, intermittently fluidizing the particulate ore with a liquid for moving the ore from the tank feed end to the tank discharge end, and continuously withdrawing liquid from the tank bottom at the base of the bed of coarse particulate material for recycle for intermittently fluidizing the particulate ore.

More particularly, the method of the invention for beneficiating particulate ores containing values comprises forming a tank having a feed end and discharge end forming a bed of coarse particulate material in said tank, adding a leach solution to said tank, feeding the particulate ore containing values soluble in said leach solution to said tank at the feed end thereof, applying an intermittent pulse of leach solution to fluidize the ore particles whereby a jigging action is created to move said ore particles up and down for classifying said particles and for moving the classified particles from the feed end to the discharge end of the tank, whereby said particles are stratified concurrently while values are dissolved by the leach solution, withdrawing particles from the tank and rinsing said particles with an intermittent pulse of water prior to discharge, and withdrawing the leach solution by filtering through the bed of particulate material for recovery of the values therefrom.

The apparatus of the invention for treating a particulate ore for the recovery of contained values therefrom comprises, in its broad aspect, the combination of a tank containing a liquid, said tank having a feed end and a discharge end, means for feeding said particulate ore to the tank at the feed end thereof, means for intermittently fluidizing the particulate ore in the tank with the liquid for classifying the ore particles and for moving the classified particles from the feed end to the discharge end of the tank, means for withdrawing and rinsing the classified ore particles, and means for withdrawing the liquid therefrom.

The bottom surface of the tank is preferably horizontal and divided into chambers, a first main chamber extending from the feed end of the tank approximately $\frac{7}{8}$ of the distance of the tank, and at least one, preferably two, smaller chambers at the discharge end thereof.

The liquid preferably is a leach solution for concurrently leaching values from the ore while the ore moves from the feed end to the discharge end of the tank, whereby leached values are withdrawn from the tank with the leach solution.

The means for feeding said particulate ore to the tank at the feed end thereof comprises a conveyor or a plurality of equispaced spigots for feeding said particulate ore as a slurry.

The means for rinsing and withdrawing said particulate ore preferably comprises a series of three materials handling wheels, the first of which withdraws particulate ore from the main tank chamber, deposits said particulate ore into a first small chamber at the discharge end of said tank wherein rinse water or recovered lixivium is pulsed to fluidize the particulate ore, the second of which withdraws the rinsed particulate ore from the first smaller chamber and deposits the particulate ore into a second small rinse chamber wherein water is pulsed to fluidize the particulate ore, and the third of which withdraws said particulate ore as tailings from said second small chamber and deposits said particulate ore onto a tailings discharge device such as a conveyer belt.

The bottom of the tank is filled with a layer of crushed stone and preferably is covered with a coarse wire mesh.

The means for intermittently fluidizing the particulate ore in the tank comprises a plurality of pipes equispaced along the bottom of the tank's main chamber having openings formed therein for the discharge of liquid into the tank under pressure above the beds of crushed stone for at least 5 seconds, preferably 5 to 10 seconds. The means for withdrawing leach solution from the tank preferably comprises a separate set of plurality of pipes adjacent the bottom surface of said tank, said leach solution being continuously withdrawn from the tank for recycle to fluidize the particulate ore. Once the values reach a desired saturation level, the leach solution is withdrawn for recovery of values and can be returned for re-use.

BRIEF DESCRIPTION OF THE DRAWINGS

The method and apparatus of the invention will now be described with reference to the accompanying drawings, in which.

DESCRIPTION OF PREFERRED EMBODIMENTS OF THE INVENTION

Figure 1:
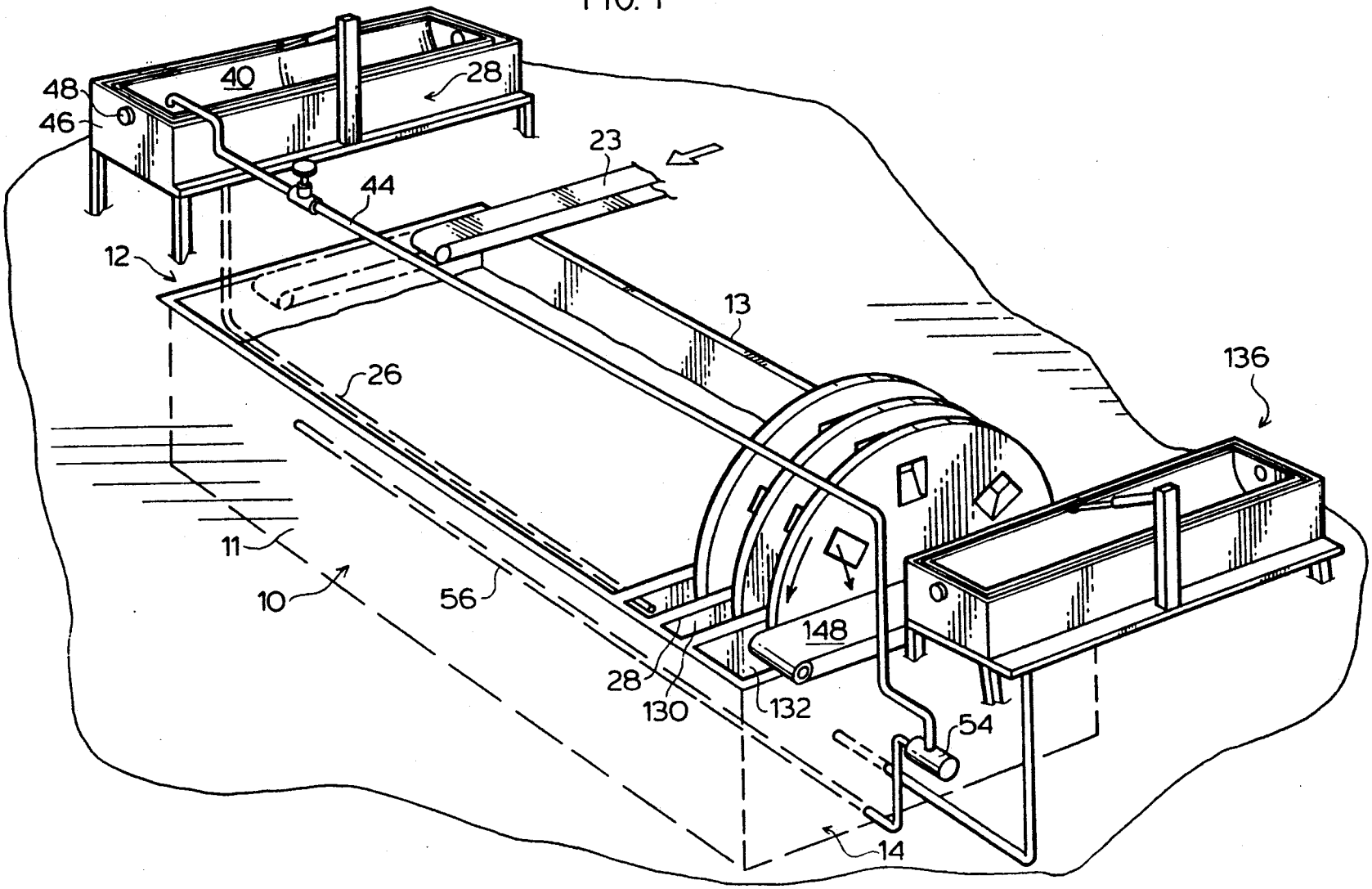
FIG. 1 perspective view of an embodiment of the apparatus of the present invention.
Figure 2:
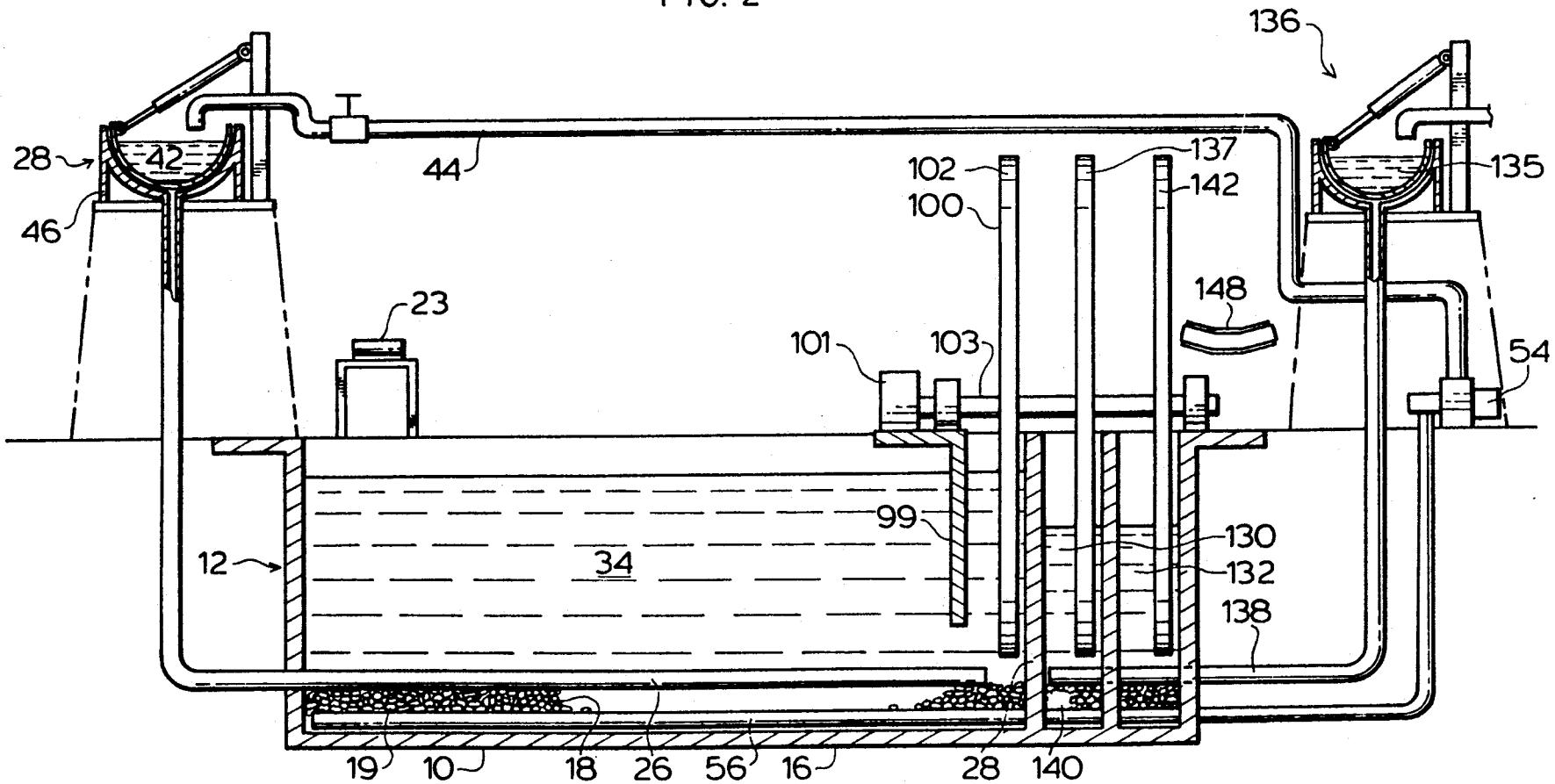
FIG. 2 is a longitudinal vertical section of the embodiment of the invention shown in FIG. 1.
Figure 3:
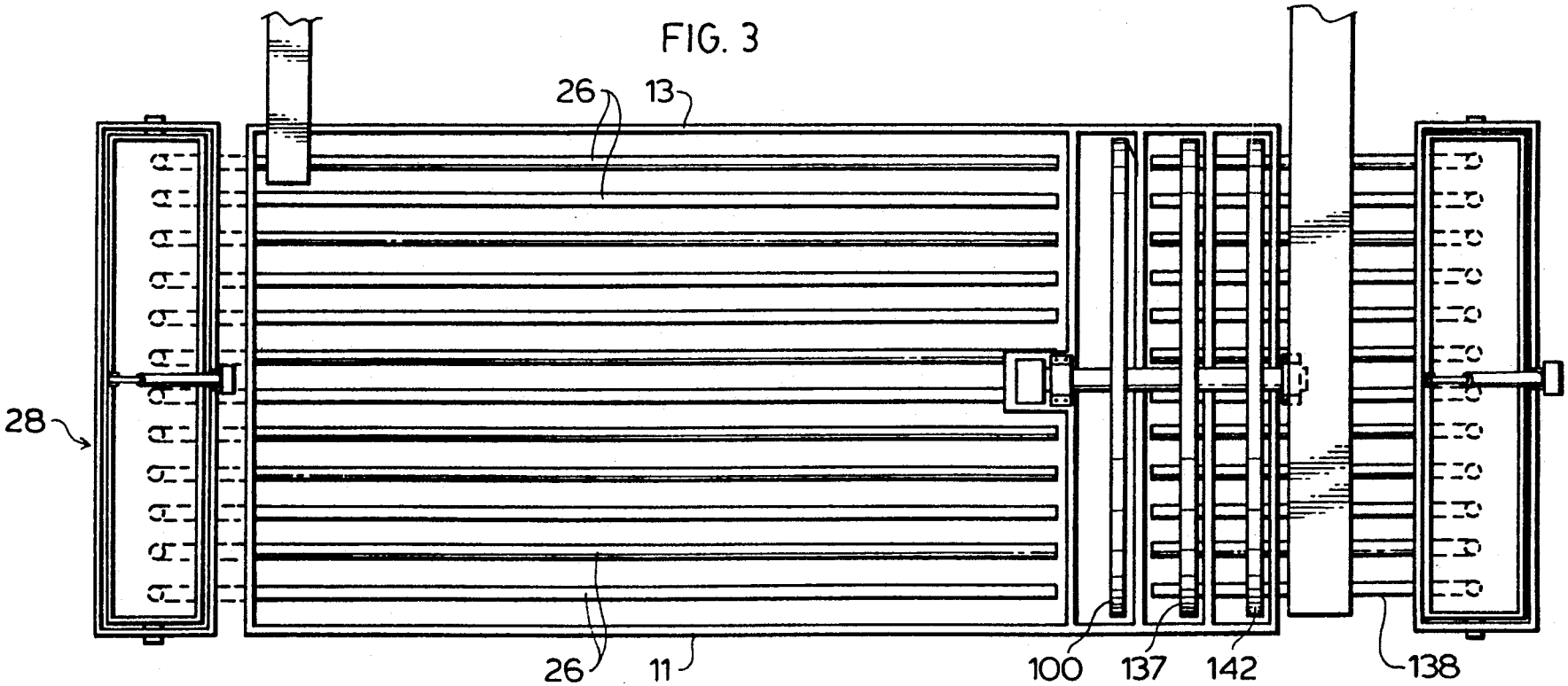
FIG. 3 is a plan view of the embodiment of the invention shown in FIG. 1.

With reference of FIGS. 1-3, the apparatus of the invention comprises a tank 10 normally rectangular in plan with side walls 11, 13 having a feed end 12 and a discharge end 14 with a horizontal bottom surface 16. Tank 10 may be a lined or unlined pit formed in rock, such as by blasting, or may be a metal or concrete container.

At least a substantial portion of the bottom surface 16 of the tank 10 is covered with a particulate material such as crushed stone 18 to form a bed 19 which may be restrained by means of a wire mesh grid or screen 20 which overlays the crushed stone. This grid may have a mesh finer than the finer particles of the particulate ore to prevent infilling of the crushed stone with the ore particles. The crushed stone preferably is graded from coarse to fine in size, from $1\frac{1}{2}$ inch to $\frac{3}{8}$ inch in diameter. If the particulate ore is $\frac{3}{8}$ inch or larger in size, screen 22 preferably has $\frac{1}{4}$ inch mesh openings to separate the ore from the crushed stone bed.

Particulate ore may be fed to tank 10 at feed end 12 uniformly across the width of the tank by a screw conveyor or by a belt conveyor 23 adapted to reciprocate across the tank as depicted in FIG. 1.

A plurality of equispaced pipes 26 extend from elevated reservoir tank 28 at the feed end 12 to rest on the crushed stone bed 19 along the length of tank 10 to the transverse partition 28. Liquid is introduced into tank 10 through a plurality of spaced perforations such as holes 36 provided along pipes 26. Pipes 26 are uniformly spaced apart about 6 to 12 inches and holes 36 are spaced along pipes 26 about 6 to 12 inches. Holes 36 may be formed on the top, side, or underside of pipes 26, the holes preferably being formed along the underside of pipes 26.

Figure 5:
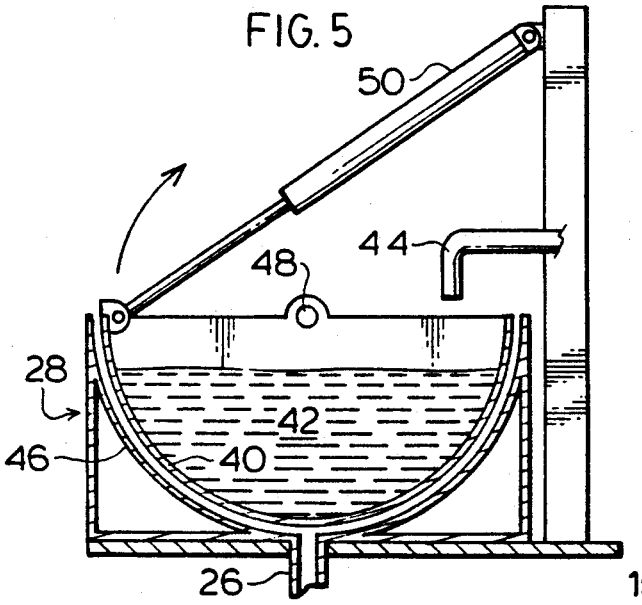
FIG. 5 is a transverse section of an embodiment of a liquid reservoir tank shown in FIG. 1.

Reservoir tank 28 is elevated at a height above tank 10 sufficient to provide a pressure head of about 20 psi above the static pressure at the level of the horizontal portion of pipes 26 to provide the desired inflow of liquid to tank 10 for fluidizing particulate ore 34. In a preferred embodiment, as depicted in FIG. 1 and 5, reservoir tank 25 comprises a longitudinally split rotatable drum 40 which is filled with liquid 42 from return pipe 44, to be described, until such time as there is sufficient quantity of liquid 42 to substantially fill rotatable drum 40 at which time drum 40 is rotated about pivot points 48 at its longitudinal axis within tank housing 46, such that liquid 42 spills into tank housing 48 connected to supply pipes 26. Pneumatic or hydraulic piston-cylinder 50 rotates rotatable drum 72 when drum 72 is full of liquid 42 and returns drum 72 to its original upright position when empty such that filling of rotatable drum 72 by return pipe 44 may resume.

Liquid 42 can be a leach solution or lixivium to dissolve values such as metal values from the particulate ore. For example, the leach solution can be a sodium cyanide solution for dissolving gold from gold ores. It is also contemplate that liquid 42 can be water for classifying bitumen in ores such as oil sands whereby the bitumen is separated into discrete flakes which are separated from inorganic particles such as the sand and silt to form an upper strata on the inorganic particles for separate removal by a weir or the like at the discharge end of the tank 10.

Figure 4:
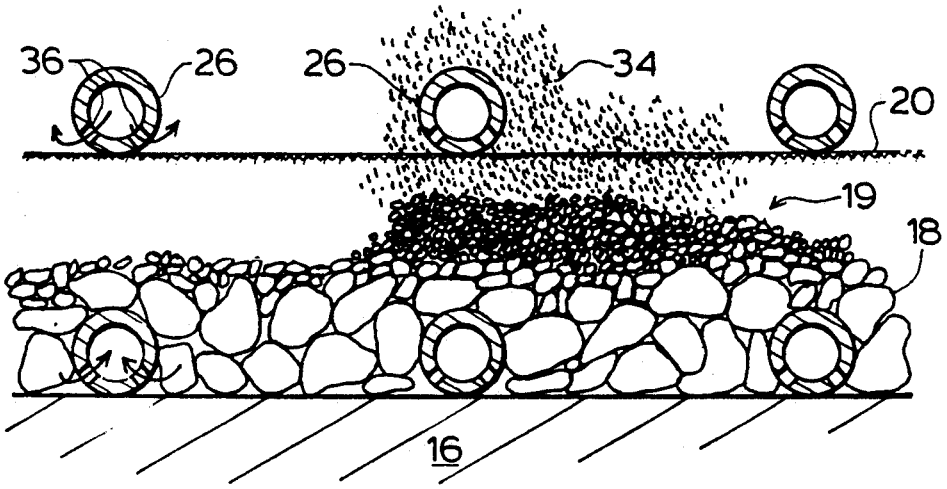
FIG. 4 is an enlarged fragmentary view of the bed of coarse particulate material.

Suction pump 54 is in communication with a plurality of equispaced perforated discharge pipes 56 disposed along the bottom surface 16 of tank 10 at the base of crushed stone bed 19, as shown in FIG. 4, for withdrawal of liquid from tank 10. Discharge line 44 from pump 54 circulates liquid to reservoir tank 28 for filling rotatable drum 40.

Figure 7:
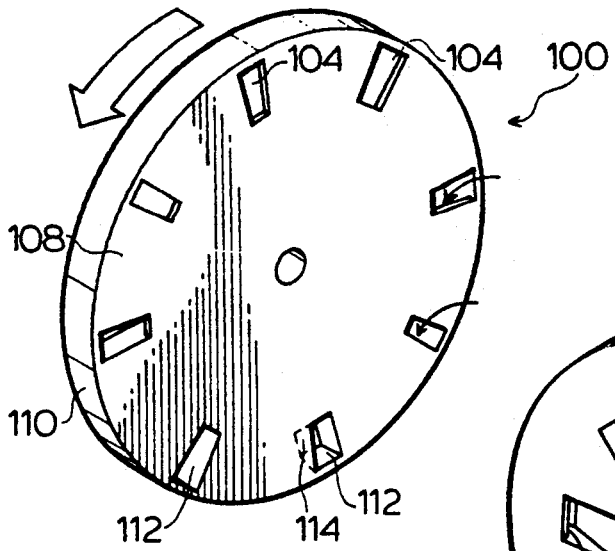
FIG. 7 is a front perspective view of the material handling wheel shown in FIG. 1.
Figure 8:
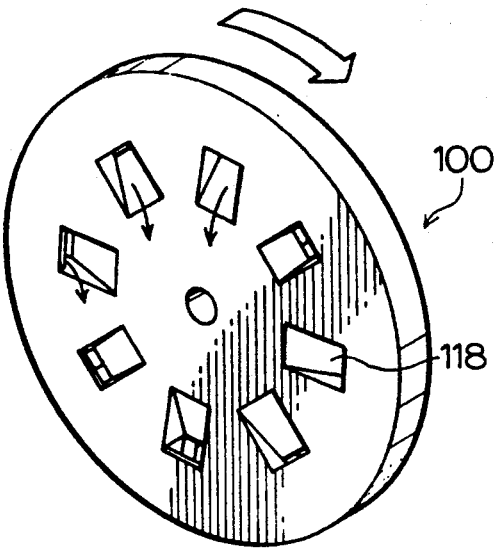
FIG. 8 is a rear perspective view of the material handling wheel shown in FIG. 7.
Figure 9:
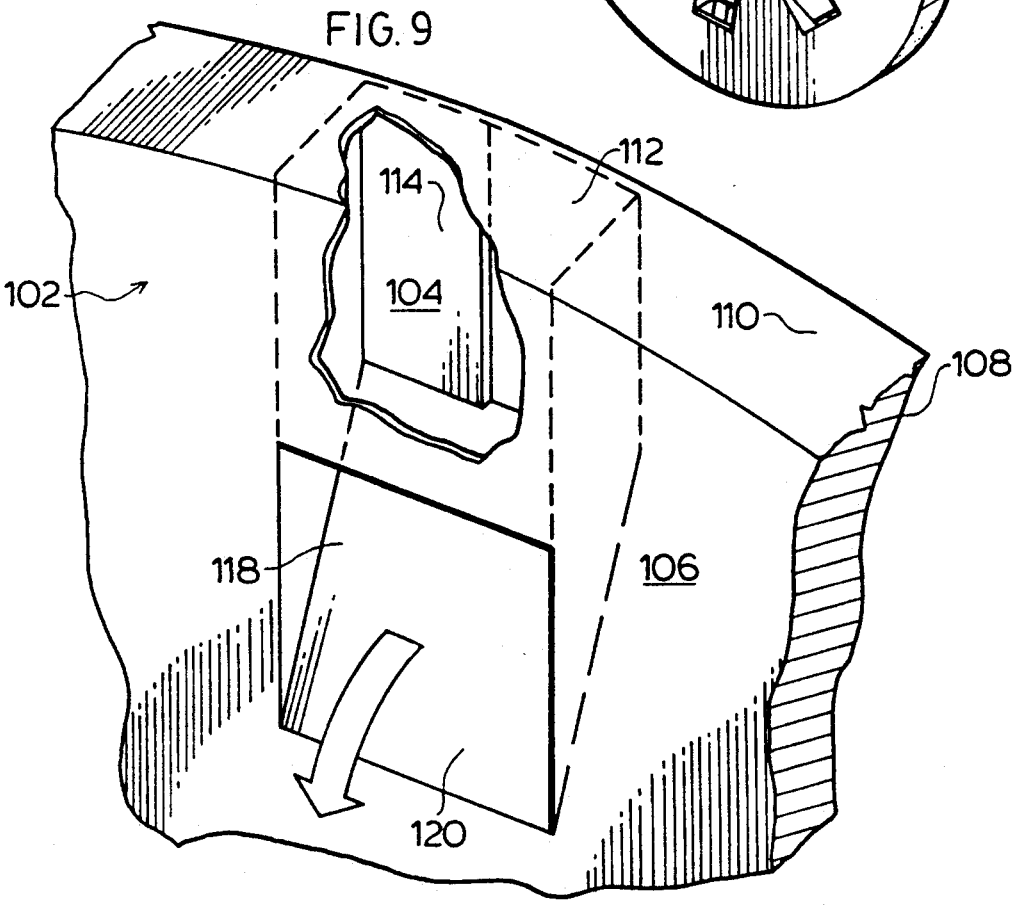
FIG. 9 is an enlarged perspective view, partly cut away, of a peripheral packet formed in said material handling wheel

Tailings are withdrawn from the discharge end 14 of tank 10 by material handling wheel 100 having a diameter sufficiently large such that its periphery 102 is immersed in bed 34. Wheel 100 driven by motor 10 coupled to shaft 103 has a plurality of equispaced pockets 104 formed about its periphery between side walls 106, 108 and closed by rim 110. Openings 112 formed in wall 108 at the periphery 102 are adapted to receive tailings during immersion in the fluidized ore bed. The tailings are restrained from escaping from pockets 104 by side wall extension 114 as the wheel rotates in the direction depicted by the arrows in FIGS. 7 and 8 and, as the pockets are elevated above the wheel horizontal diameter, the tailings slide out of the pockets 104 through openings 118 on bevelled surface 120, as depicted by the arrow in FIG. 9. The tailings thus are conveyed from tank 10 into chamber 130, to be described.

Although tank 10 is shown to have two transverse chambers 130, 132 at its discharge end 14, it will be understood that tank 10 may have no transverse chambers or may have more than two chambers. Particulate ore transferred from tank 10 into chamber 130 by wheel 100 is fluidized in chamber 130 by the introduction of a wash liquid 135 such as make-up water from elevated reservoir 136 through at least one perforated pipe 138, preferably a plurality of pipes 138, seated on coarse particulate material such as crushed stone 140. Reservoir 136 preferably is of the same construction as reservoir 28 and intermittently discharges a quantity of liquid under pressure into chamber 130. Discharge pipes 56 in tank 10 preferably pass through chamber 130 at the base of material 140 to continuously withdraw liquid therefrom to mix with the leach solution from tank 10 for recycle to reservoir 28.

A similar material handling wheel mounted for rotation in transverse chamber 130 adjacent to and in sequence with wheel 100 transfers washed particulate ore from chamber 130 to chamber 132 for secondary washing of the particulate ore by fluidizing with make-up water from pipes 138 passing therethrough. Wash water is continuously withdrawn by pipes 138 for recycle to reservoir 28. Material handling wheel 142 mounted for rotation in transverse chamber 144 transfers washed tailings from chamber 132 to continuous belt conveyor 148 for removal and disposal.

Figure 6:
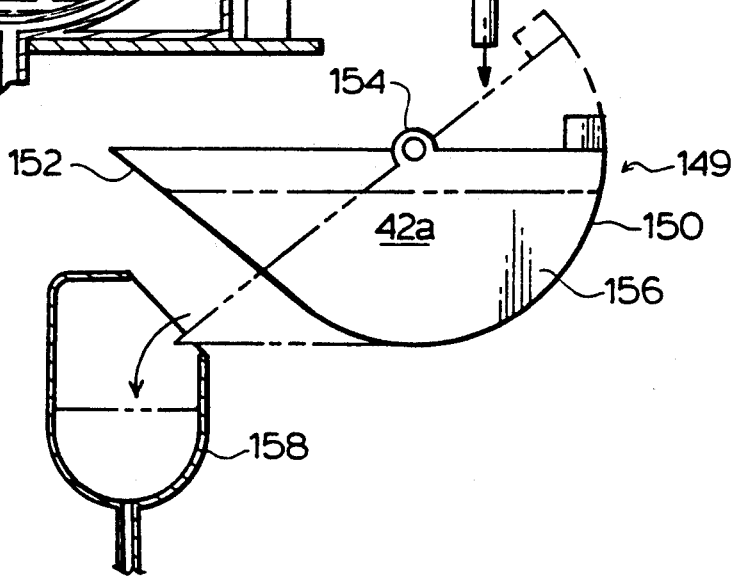
FIG. 6 is a transverse section of a second embodiment of a self-dumping liquid reservoir tank.

FIG. 6 illustrates another embodiment of elevated reservoir tank 149 for intermittently feeding a quantity of leach solution under pressure to pipes 26. A substantially half cylindrical wall 150 or arcuate trough having a tangential edge extension 152 is pivotally mounted at its longitudinal axis 154 on end walls 156 whereby the weight of liquid **42*a* therein fed by pipe 44 will cause the tank to tip about its axis and discharge its contents into stationary trough 158 which is in communication with pipes 26. The embodiment of tank 149 can also be used for introduction of wash liquid into transverse chambers 130, 132**.

In operation, ore such as gold-bearing ore normally is crushed to 100% passing 6 Tyler mesh, or to 100% passing 50 Tyler mesh or smaller, as is appropriate for the ore to be leached, and preferably is fed to tank 10 by conveyor 23.

Liquid 42 such as a leach solution is intermittently supplied to tank 10 from tank 28 through openings 36 in pipes 26. A uniform flow of liquid thus is pulsed upwardly across the bottom and along the length of tank 10 to fluidize the particulate ore above the crushed stone base for at least five seconds, normally for a period of time of 5 to 10 or seconds until the contents of tank 28 are depleted. The temporary fluidizing of particulate ore 34 permits classifying and stratification of the ore according to particle size, shape and density, the coarser and heavier particles of rounded shape normally forming a lower layer while the lighter, finer and angular or plate-shaped particles normally forming upper strata. The fluidizing of the ore particles causes attrition of the particles among themselves while washing the particle surfaces with liquid to enhance dissolving of the values in the leach solution.

Pump 54 continuously withdraws leach solution from tank 10 through beds 18 and 34 by way of perforated pipes 56 for recycle to reservoir tank 26 through line 44. The particulate ore settles on crushed stone bed 19 which together form an effective filter bed (french drain) to prevent egress of fine particles with the liquid withdrawn from tank 10.

The classified particulate ore 34 migrates with the repeat of each fluidizing and settling cycle towards the discharge end 14 of tank 10 for withdrawal and rinsing before final discharge via tailings discharge conveyor 149.

Withdrawal and rinsing of tailings is accomplished by materials handling wheels 100, 137 and 142 maintained in sequence at discharge end 14 of the tank 10 for simultaneous rotation on shaft 103 by drive 101. As materials handling wheel 100 rotates, tailings are transferred from the main portion of tank 10 to chamber 130 for a first-stage washing by wash liquid 135 from reservoir 136. A uniform flow of rinse water 135 rinses the tailings by fluidizing the solids for at least five seconds, normally for a period of time of five to ten seconds or until the wash liquid is depleted, to wash the lixivium from the tailings. Water is usually the preferred rinsing liquid.

Particulate ore deposited in first transverse chamber 130 by first materials handling wheel 100 enters second materials handling wheel 137 at its periphery and is transferred to second transverse chamber 132 for a second-stage washing by rinse water 135 as described above with reference to the first-stage washing. A third materials handling wheel 142 transfers the washed solids onto tailings discharge conveyor 148 which conveys rinsed particulate ore tailings to a tailings disposal system. The wash water containing values is recovered from chambers 130, 132 and recycled to elevated reservoir 28.

It will be understood that although the description of the method and apparatus of the invention has proceeded with reference to the leaching of gold from ores by means of sodium cyanide solution, the invention has utility in leaching sulphates and the like ores with acid leachants for recovery of metal values such as copper, nickel and lead. Values such as bitumen in oil sands can be beneficiated by classification and recovered as a slurried solid concentrate.

It will also be understood that modifications can be made in the embodiment of the invention illustrated and described herein without departing from the scope and purview of the invention as defined by the appended claims.

What I claim as new and desire to protect by Letters Patent of the United States is:

1. An apparatus for treating a particulate ore for the recovery of contained values therefrom comprising, in combination: a tank for receiving a liquid, said tank having a feed end, a discharge end and a bottom, said tank adapted to receive a bed of coarse particulate material on the tank bottom, said bed having a base adjacent the tank bottom; means for feeding the particulate ore to the tank at the feed end thereof; means for intermittently fluidizing the particulate ore in the tank for moving the ore particles from the feed end to the discharge end of the tank; means for withdrawing the ore particles at the tank discharge end; means at the bottom of the tank at the base of the bed of coarse particulate material for continuously withdrawing the liquid therefrom; and means for recycling the said liquid for intermittently fluidizing the particulate ore in the tank.

2. An apparatus as claimed in claim 1 wherein said liquid is a leach solution and said particulate material is a coarse particulate material.

3. An apparatus as claimed in claim 2 wherein said means for intermittently fluidizing the particulate ore in the tank with the leach solution comprises a plurality of pipes spaced across the bottom of the tank on the bed of coarse particulate material, said pipes having openings equispaced along said pipes for the discharge of each solution into the tank below the particulate ore.

4. An apparatus as claimed in claim 3 wherein the plurality of pipes are uniformly laterallyspaced apart about 6 to 12 inches and the openings are equispaced about 6 to 12 inches along the pipes.

5. An apparatus as claimed in claim 4 including means for supplying said solution under pressure to said plurality of pipes for at least 5 seconds.

6. An apparatus as claimed in claim 4 wherein said solution is supplied under pressure for a time of 5 to 10 seconds.

7. An apparatus as claimed in claim 3 wherein said means for continuously withdrawing leach solution from the tank comprises a plurality of perforated bottom pipes at the base of coarse particulate material in communication with a pump.

8. An apparatus as claimed in claim 7 wherein the bed of coarse particulate material is crushed stone graded from coarse to fine.

9. An apparatus as claimed in claim 8 wherein said bed of particulate material is crushed stone and means are provided for restraining said crushed stone comprising a coarse wire mesh for overlaying the bed of crushed stone.

10. An apparatus as claimed in claim 6 wherein said bed of particulate material is crushed stone and means are provided to restrain the crushed stone including a screen for overlaying the layer of crushed stone, said screen having a mesh size finer than the finer particles of particulate ore to prevent infilling of the crushed stone with ore particles.

11. An apparatus as claimed in claim 8 wherein said means for intermittently fluidizing the particulate ore in the tank with the leach solution comprises an elevated reservoir tank in communication with the plurality of perforated pipes spaced across the bottom of the tank.

12. An apparatus as claimed in claim 7 in which said means for intermittently fluidizing the particulate ore includes an elevated reservoir tank in communication with the plurality of perforated pipes on the bed of crushed stone and at the bottom of the particulate ore for intermittent discharge of leach solution under pressure into the tank, and said means for continuously withdrawing the leach solution includes a pump in communication with the plurality of perforated bottom pipes at the base of the bed of crushed stone and in communication with the elevated reservoir tank for continuously recycling leach solution to the reservoir tank.

13. An apparatus as claimed in claim 12 in which the perforated pipes have perforations formed on the underside thereof.

14. An apparatus as claimed in claim 12 in which said elevated reservoir tank comprises an outer tank in communication with the plurality of perforated pipes, an inner tank for receiving recycled leach solution having a substantially half cylindrical wall closed at each end, and means for intermittently pivoting said inner tank within the outer tank for discharge of leach solution into the outer tank.

15. An apparatus as claimed in claim 14 in which said half cylindrical wall is closed at each end by semi-circular end walls having pivot supports at the longitudinal axis of the half cylindrical wall and in which said means for intermittently pivoting said inner tank comprises a hydraulic or pneumatic piston-cylinder assembly operatively connected to the inner tank.

16. An apparatus as claimed in claim 12 in which said elevated reservoir tank comprises a substantially half cylindrical elongated wall having a tangential lip extension along one side edge thereof, end walls closing each end of the elongated wall including the tangential lip extension, said end walls having pivot supports at the longitudinal axis of the substantially half cylindrical elongated wall, whereby filling of the reservoir tank with leach solution unbalances the reservoir tank to cause the reservoir tank to pivot and intermittently discharge contained leach solution into said plurality of fluidizing pipes.

17. An apparatus as claimed in claim 1 in which said means for withdrawing the ore at the tank discharge end comprises at least one wheel having a pair of spaced apart sidewalls mounted for rotation at the tank discharge end, said wheel having a periphery of sufficiently large diameter whereby the wheel periphery substantially penetrates the depth of the particulate ore during rotation thereof, said wheel having a plurality of equispaced pockets formed about its periphery between the sidewalls, each of said pockets having a first wall opening on one sidewall of the wheel adjacent the periphery for collecting particulate ore at one side of the wheel while the said pockets are immersed in the ore and each of said pockets having a second wall opening on the opposite side wall of the wheel inwardly towards the centre of the wheel relative to the first sidewall opening whereby ore collected in said pockets is discharged from the said opposite side of the wheel as the pockets are elevated above the horizontal diameter of wheel.

18. An apparatus as claimed in claim 1 in which the tank has a transverse chamber formed at the discharge end thereof, said means for withdrawing the ore at the tank discharge end comprising at least two transfer wheels mounted for rotation in sequence at the tank discharge end, each of said wheels having a periphery of sufficiently large diameter whereby the wheel periphery of substantially penetrates the depth of the particulate solids during rotation thereof, said wheels each having a pair of spaced apart sidewalls and a plurality of equispaced pockets formed about the periphery between the sidewalls, each of said pockets having a first wall opening on one side wall of the wheel adjacent the periphery for collecting the particulate solids at said one side of the wheel while the said pockets are immersed in the ore and each of said pockets having a second wall opening on the opposite sidewall of the wheel inwardly towards the centre of the wheel relative to the first sidewall opening whereby ore collected in said pockets is discharged from the opposite side of the wheel as the pockets are elevated above the horizontal diameter of the wheel, the first of said two transfer wheels being mounted for rotation in the tank for transferring particulate solids from the tank to the transverse chamber and the second transfer wheel mounted for rotation in the transverse chamber for transferring particulate solids from the transverse chamber for discharge therefrom.

19. An apparatus as claimed in claim 18 in which the tank has a second transverse chamber formed at the discharge end thereof adjacent the first transverse chamber for receiving solids from the second transfer wheel, said means for withdrawing the solids additionally comprises a third wheel mounted for rotation in the second transverse chamber in sequence with the second wheel for transferring particulate solids from the second transverse chamber for discharge as tailings therefrom.

20. An apparatus as claimed in claim 18 in which said transverse chamber is adapted to receive a bed of coarse particulate material, at lease one pipe having a plurality of equispaced openings along its length disposed in the transverse chamber on the bed of coarse particulate material for fluidizing particulate solids, at least one pipe having a plurality of equispaced openings along its length disposed in the transverse chamber at the base of the coarse particulate material in communication with the means for continuously withdrawing the liquid from the tank, and means for supplying a liquid under pressure to said pipe for fluidizing the particulate solids.

21. An apparatus as claimed in claim 20 in which said means for supplying a liquid under pressure comprises an elevated reservoir tank in communication with said pipe for fluidizing the particulate solids, said elevated reservoir tank comprising a substantially half cylindrical elongated wall having a tangential lip extension along one side edge thereof, end walls closing each end of the elongated wall including the tangential lip extension, and said end walls having pivot supports at the longitudinal axis of the substantially half cylindrical elongated wall, whereby filling of the reservoir tank with liquid unbalances the reservoir tank to cause the reservoir tank to pivot and intermittently discharge contained liquid into said fluidizing pipe.

22. An apparatus as claimed in claim 20 in which said means for supplying a liquid under pressure comprises an elevated reservoir tank in communication with said pipe for fluidizing the particulate ore, said elevated reservoir tank comprising an outer tank in communication with the plurality of perforated pipes, an inner tank for receiving recycled leach solution having a substantially half cylindrical wall closed at leach end, and means for intermittently pivoting said inner tank within the outer tank for discharge of each solution into the outer tank.

23. An apparatus as claimed in claim 19 in which said transverse chambers are each adapted to receive a bed of coarse particulate material, at least one pipe having a plurality of equispaced openings along its length disposed in each of the transverse chambers at the base of the coarse particulate material in communication with the means for continuously withdrawing the liquid from the tank, and means for supplying a wash liquid under pressure to said pipes for fluidizing the particulate solids.

24. An apparatus as claimed in claim 23 in which said means for supplying a liquid under pressure comprises an elevated reservoir tank in communication with said pipes for fluidizing the particulate ore, in which said elevated reservoir tank comprises a substantially half cylindrical elongated wall having a tangential lip extension along one side edge thereof, end walls closing each end of the elongated wall including the tangential lip extension, said end walls having pivot supports at the longitudinal axis of the substantially half cylindrical elongated wall, whereby filling of the reservoir tank with leach solution unbalances the reservoir tank to cause the reservoir tank to pivot and intermittently discharge contained leach solution into said plurality of fluidizing pipes.

25. An apparatus as claimed in claim 23 in which said means for supplying a liquid under pressure comprises an elevated reservoir tank in communication with said pipe for fluidizing the particulate ore, said elevated reservoir tank comprising an outer tank in communication with the plurality of perforated pipes, an inner tank for receiving recycled leach solution having a substantially half cylindrical wall closed at each end, and means for intermittently pivoting said inner tank within the outer tank for discharge of each solution into the outer tank.

26. A reservoir tank for intermittently feeding a liquid comprising an outer tank having a liquid outlet, an inner tank for receiving a liquid having a substantially half cylindrical wall closed at each end by semi-circular end walls having pivot supports at the longitudinal axis of the half cylindrical wall, and means for intermittently pivoting said inner tank within the outer tank for discharge of liquid into the outer tank comprising a hydraulic or pneumatic piston-cylinder assembly operatively connected to the inner tank.

27. An apparatus for withdrawing particulate solids from a bed of solids comprising at least one wheel having a pair of spaced apart sidewalls mounted for rotation in the said bed, said wheel having a periphery of sufficiently large diameter whereby the wheel periphery substantially penetrates the depth of the solids in the bed during rotation thereof, said wheel having a plurality of equispaced pockets formed about the periphery between the sidewalls, each of said pockets having a first wall opening on one sidewall of the wheel adjacent the periphery for collecting solids at one side of the wheel while the said pockets are immersed in the bed and each of said pockets having a second wall opening on the opposite side wall of the wheel inwardly towards the centre of the wheel relative to the first sidewall opening whereby ore collected in said pockets is discharged from the opposite side of the wheel as the pockets are elevated above the horizontal diameter of the wheel.

* * * * *